United States Patent [19]

Bond

[11] Patent Number: 5,012,854

[45] Date of Patent: May 7, 1991

[54] PRESSURE RELEASE VALVE FOR A SUBSEA BLOWOUT PREVENTER

[75] Inventor: John A. Bond, Houston, Tex.

[73] Assignee: Baroid Technology, Inc., Houston, Tex.

[21] Appl. No.: 33,041

[22] Filed: Mar. 31, 1987

[51] Int. Cl.[5] ..... E21B 33/064; E21B 34/04; E21B 43/12

[52] U.S. Cl. ..... 166/363; 166/95; 166/97; 166/321; 166/364; 175/218; 251/1.1; 251/63.6

[58] Field of Search ..... 166/335, 363, 364, 91, 166/90, 97, 95, 321; 175/218; 251/1.1, 1.2, 1.3, 339, 63.5, 63.6

[56] References Cited

U.S. PATENT DOCUMENTS

| | | | |
|---|---|---|---|
| 3,219,118 | 11/1965 | Lewis | 166/97 X |
| 3,457,991 | 7/1969 | Sizer et al. | 166/363 |
| 3,508,577 | 4/1970 | Vincent et al. | 175/218 X |
| 3,913,883 | 10/1975 | Irwin | 251/63.6 X |
| 4,046,191 | 9/1977 | Neater | 166/363 X |
| 4,470,430 | 9/1984 | Lancaster | 175/218 X |
| 4,546,828 | 10/1985 | Roche | 251/1.1 X |
| 4,662,603 | 5/1987 | Etheridge | 251/63.5 |

*Primary E ·iner*—Hoang C. Dang

*Attorney, Agent, or Firm*—Browning, Bushman, Anderson & Brookhart

[57] ABSTRACT

The specific embodiment comprises a valve piston mounted on a shaft that is slidably disposed within an aperture in the lower housing of the blowout preventer. The valve piston and shaft may be extended into the central passage of the BOP in an open position through the use of a hydraulic operator assembly. When the valve piston and shaft have been extended into the open position, the wellbore gases enter into the annular space between the shaft and the aperture through the lower housing of the BOP. The wellbore gases are then vented from the aperture through an open vent conduit to the outside of the BOP.

The hydraulic operator assembly is spring biased to keep the valve piston and shaft in closed position whenever the hydraulic operator assembly is not activated. The valve piston will therefore automatically close whenever there is a loss of hydraulic control. In normal operation, the hydraulic operator assembly will keep the valve piston and shaft in open position until the wellbore gases have been vented. When the venting has been completed, the hydraulic operator assembly draws the valve piston and shaft back into closed position.

2 Claims, 4 Drawing Sheets

PRESSURE RELEASE VALVE FOR A SUBSEA BLOWOUT PREVENTER

BACKGROUND OF THE INVENTION

1. Field of the Invention

This invention relates generally to subsea blowout preventers of the type used in the oil and gas drilling and production industry and, in particular, to an improved valve for venting gas through a wall of a subsea blowout preventer.

2. Description of the Background

It is well known that blowout preventers can be opened and closed to control the pressures in an earth wellbore. This is also known as either being in an unsealed (open) or in a sealed (closed) position. When a blowout preventer ("BOP") is used to control an oil or gas well that is drilled on land, it is possible to open the BOP to vent well gases under pressure that have built up in the wellbore. In subsea oil and gas operations, however, this is not possible with the subsea BOPs presently being used. The difficulty arises from the fact that the subsea BOP is situated on the sea floor and from the fact that there is often a significant length of casing from the subsea BOP on the sea floor to the drilling or production equipment mounted on the platform of the offshore rig. In the case of the drilling rig, the column of drilling mud that is present in the length of casing from the subsea BOP to the drilling platform on the rig prevents the safe and effective venting of wellbore gases that have become trapped in the annulus under the subsea BOP.

If one attempts to open and thus to vent the high pressure wellbore gases trapped under a subsea BOP through the column of drilling mud, one risks a high pressure, uncontrolled explosion of wellbore gases. The drilling mud acts as a viscous plug which unpredictably impedes the passage of the high pressure gases to the surface.

There has therefore arisen a need for a safe and effective means for venting high pressure wellbore gases without opening a subsea BOP. The present invention meets this need by providing a failsafe pressure release valve for subsea blowout preventers which is independent of whether the BOP is open.

SUMMARY OF THE INVENTION

The objectives of the present invention are accomplished, generally, by the provision of a new and improved blowout preventer having means to vent its interior without causing the blowout preventer to open, as well as by the provision of a system embodying the new and improved blowout preventer which includes means remote from said blowout preventer for controlling the venting means.

It is therefore an object of the apparatus of the invention to provide a means for the safe and effective venting of high pressure wellbore gases from a subsea blowout preventer.

Another object of the apparatus of the invention is to provide a valve piston and shaft for venting wellbore gases from a subsea blowout preventer through an aperture and open vent conduit in the body of the blowout preventer.

A further object of the apparatus of the invention is to provide an hydraulic operator assembly for opening and closing under hydraulic control the valve piston and shaft of the present invention.

Yet another object of the apparatus of the invention is to provide a means for automatically closing the valve piston and shaft of the invention when hydraulic control of the hydraulic operator assembly is lost.

These and other objects, features and advantages of the invention will be apparent from the drawings, the detailed description and the appended claims.

DETAILED DESCRIPTION OF THE PREFERRED EMBODIMENT

Figure 1:
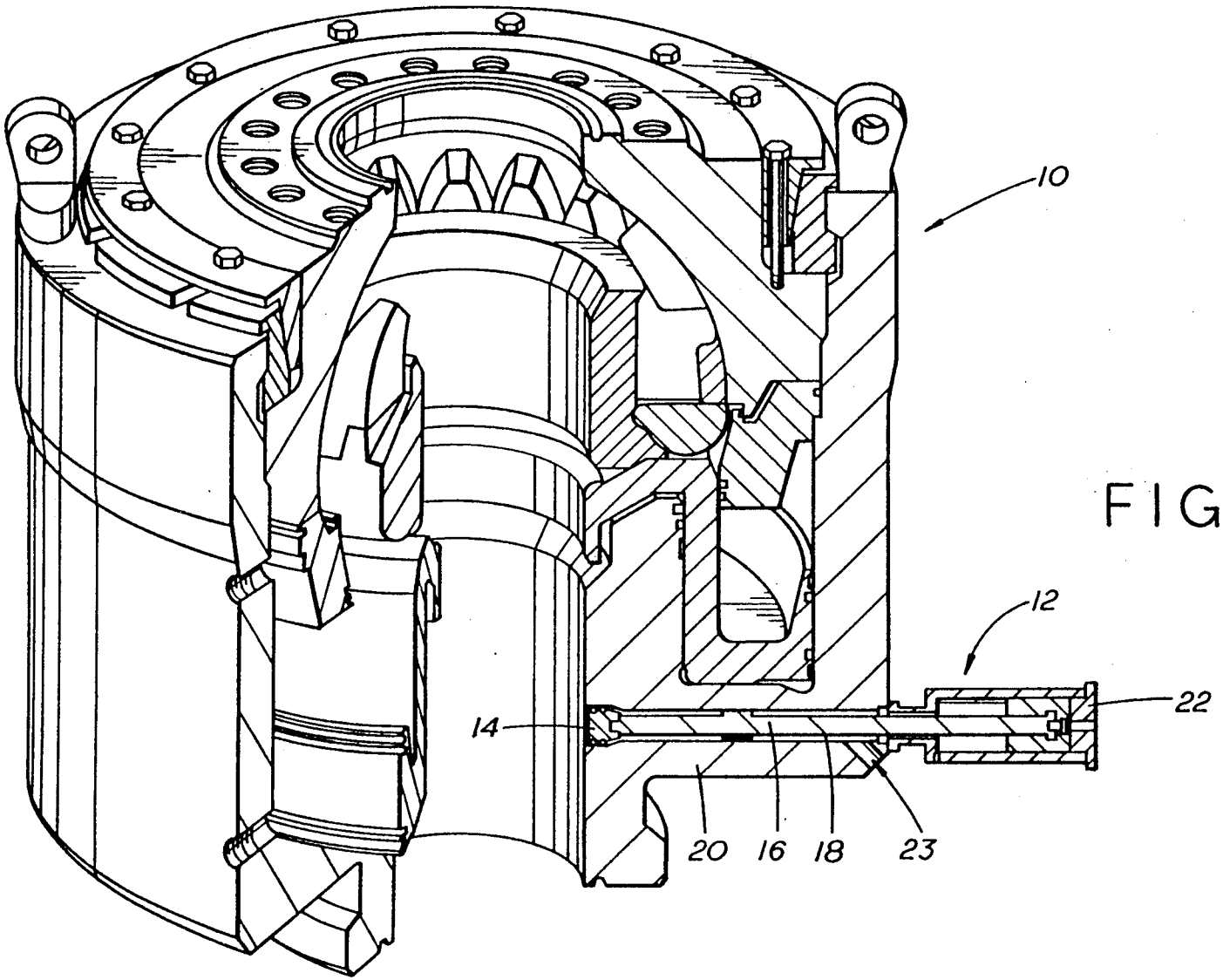
FIG. 1 is a pictorial view, partially in cross section, of a blowout preventer, including a cross-sectional view of the valve of present invention showing its location within the preventer.

With reference to the drawings, a description of the preferred embodiment of the invention will be given. The blowout preventer ("BOP") according to the invention is denoted generally by the numeral 10. Although the present invention contemplates the use of various models and types of subsea BOPs, the specific embodiment described herein contemplates the use of a spherical BOP manufactured and sold by the NL Shaffer Division of NL Industries, Inc., Houston, Texas, and as described in U.S. Pat. No. 3,667,721, assigned to NL Industries, Inc., the assignee of the present application. The disclosure of said U. S. Pat. No. 3,667,721 is incorporated herein by reference. FIG. 1 shows the placement of the pressure release valve 12 within the BOP 10 in accordance with the present invention. Pressure release valve 12 generally comprises a valve piston 14 mounted on a shaft 16. As will be explained more fully below, the shaft 16 extends through an aperture 18 in the lower housing 20 of the BOP 10 and through a hydraulic operator assembly 22. The aperture 18 extends from the central passage of the BOP to the outside of BOP 10. An open vent conduit 23 extends through the lower housing 20 of the BOP 10 to provide fluid communication between aperture 18 and the outside of BOP 10.

In the preferred embodiment of the invention, the valve piston 14, the shaft 16, the aperture 18 and the hydraulic operator assembly 22 are formed with cylindrical symmetry along the axis of shaft 16. It is clear that other embodiments of the invention may utilize other types of geometric shapes for the elements of the pressure release valve 12.

Figure 2A:
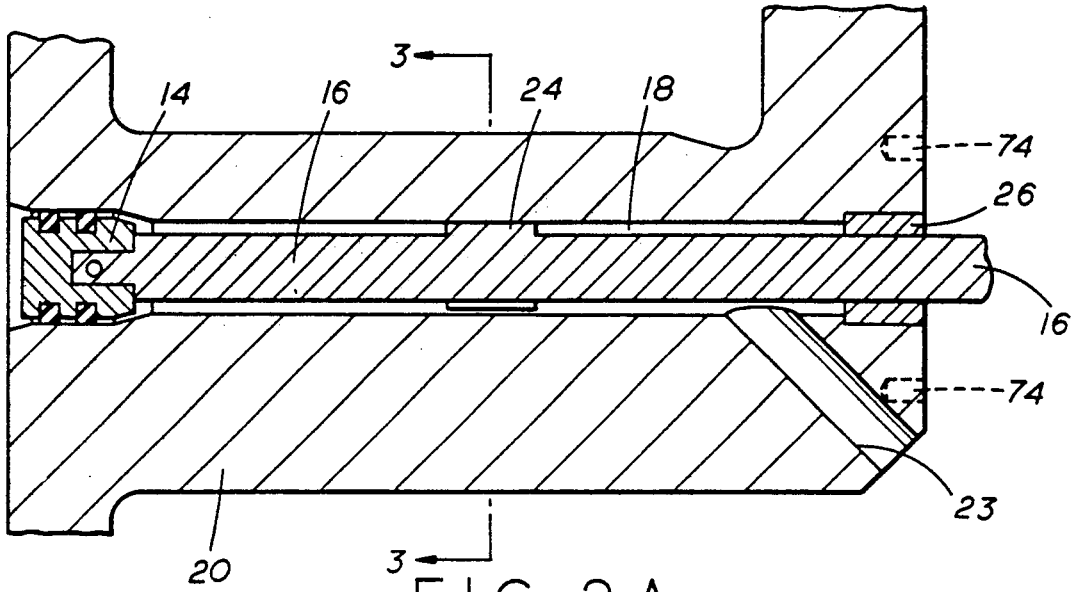
FIG. 2A depicts an elevated, cross-sectional view of the valve piston and shaft of the present invention and its placement the wall of the blowout preventer.

As shown in FIG. 1 and in FIG. 2A, the shaft 16 is slidably disposed within the cylindrically shaped aperture 18 through the lower housing 20 of the BOP 10.

Figure 3:
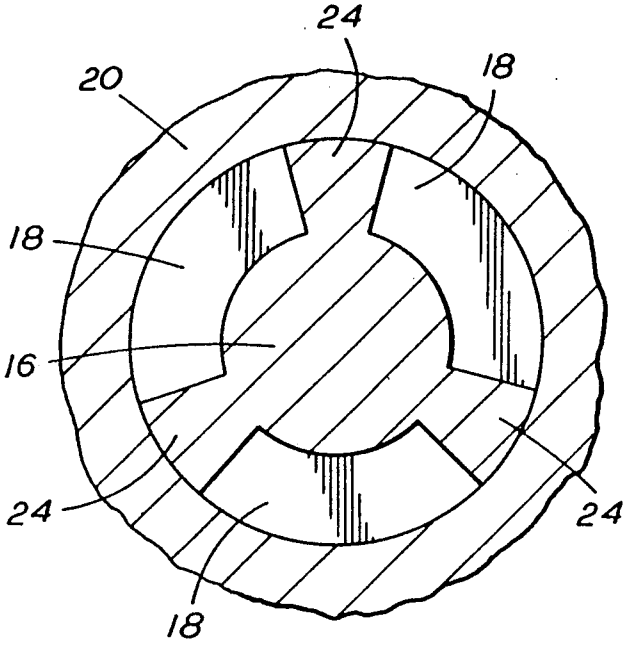
FIG. 3 shows a top plan view, partially in cross section, of valve piston taken along line 3—3 of FIG. 2A.

Shaft 16 is centered within aperture 18 by rib flanges 24 as shown in FIG. 2A and in FIG. 3. FIG. 2A shows that shaft 16 is also centered within aperture 18 by an aperture plug member 26 mounted within the outer wall of lower housing 20 of the BOP 10.

Figure 4:
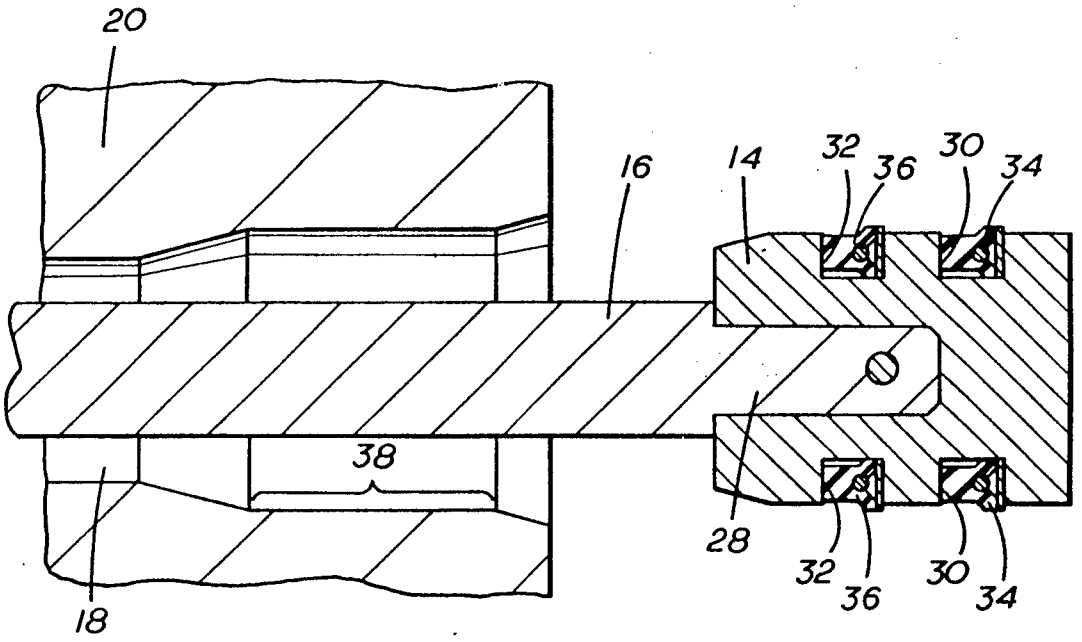
FIG. 4 depicts an elevated, cross-sectional view of the shaft in open position showing the structure of the valve piston.

A detailed cross-sectional view of the valve piston 14 and shaft 16 in open position is shown in FIG. 4. As shown in FIG. 4, valve piston 14 is fixedly mounted on the end 28 of shaft 16. Valve piston 14 is formed having circumferential grooves, 30 and 32. A first circular lip-type elastomeric 0-ring 34 is mounted within groove 30 and a second circular lip-type elastomeric 0-ring 36 is mounted within groove 32. It should be appreciated that the portion of aperture 18 adjacent to the central bore of the BOP is widened to receive valve piston 14 when shaft 16 is in closed position. Thus, when shaft 16 is in the closed position as shown in FIG. 2A, then 0-ring 34 and 0-ring 36 seal against cylindrically shaped surface 38 of the widened portion of aperture 18.

Figure 2B:
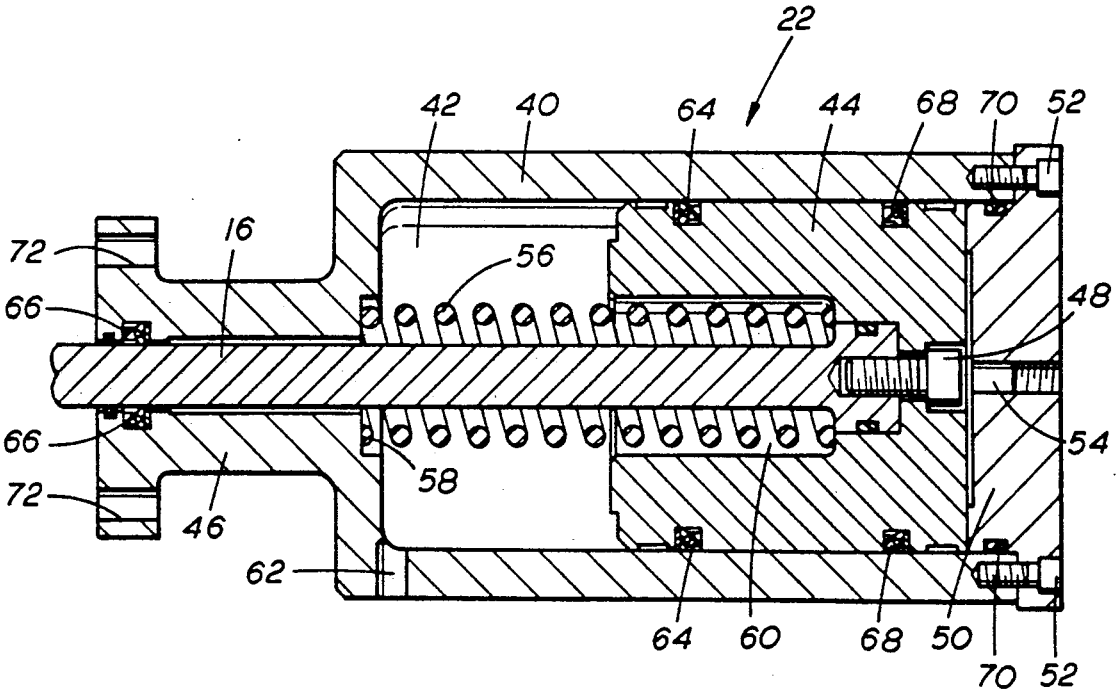
FIG. 2B illustrates an elevated, cross-sectional view of the hydraulic operator assembly of the valve of the present invention.

A detailed view of the hydraulic operator assembly 22 is shown in FIG. 2B. The hydraulic operator assembly 22 comprises a housing 40 with portions forming a piston chamber 42 within said housing 40. Piston chamber 42 contains an operator piston 44 slidably disposed at close tolerance within said piston chamber 42. Shaft 16 extends through the base 46 of housing 40 and extends into piston chamber 42 where shaft 16 is fixedly mounted to operator piston 44. In the preferred embodiment of the invention, shaft 16 is fixedly mounted to operator piston 44 via securing bolt 48.

Operator piston 44 is retained within the piston chamber 42 of housing 40 by means of a piston housing cap 50 secured to housing 40 by securing bolts 52. A conduit 54 through piston housing cap 50 permits the introduction of hydraulic or pneumatic fluid under pressure to act against operator piston 44. Biasing means such as spring 56 biases operator piston 44 against piston housing cap 50. Spring 56 is coaxially disposed around shaft 16 as shown in FIG. 2B. One end of spring 56 rests in a recessed portion 58 of housing base 46 and the other end of spring 56 rests in a recessed portion 60 of operator piston 44.

Piston chamber 42 is vented through a conduit 62 through the housing 40 of the hydraulic operator assembly 22. Circular lip-type elastomeric 0-rings, 64 and 66, prevent the leakage of fluid from piston chamber 42 other than through conduit 62. A similar 0-ring 68 prevents the leakage of hydraulic fluid through the juncture of the outer surface of operator piston 44 and the surface of housing 40. An elastomeric 0-ring 70 prevents the leakage of hydraulic fluid through the juncture of the surfaces of the piston housing cap 50 and the housing 40. The hydraulic operator assembly is secured to the lower housing 20 of the BOP 10 via bolts (not shown) that pass through bolt holes 72 in the base 46 of housing 40 and that are secured within bolt holes 74 (shown in dotted outline in FIG. 2A) of the lower housing 20 of the BOP 10.

Figure 5:
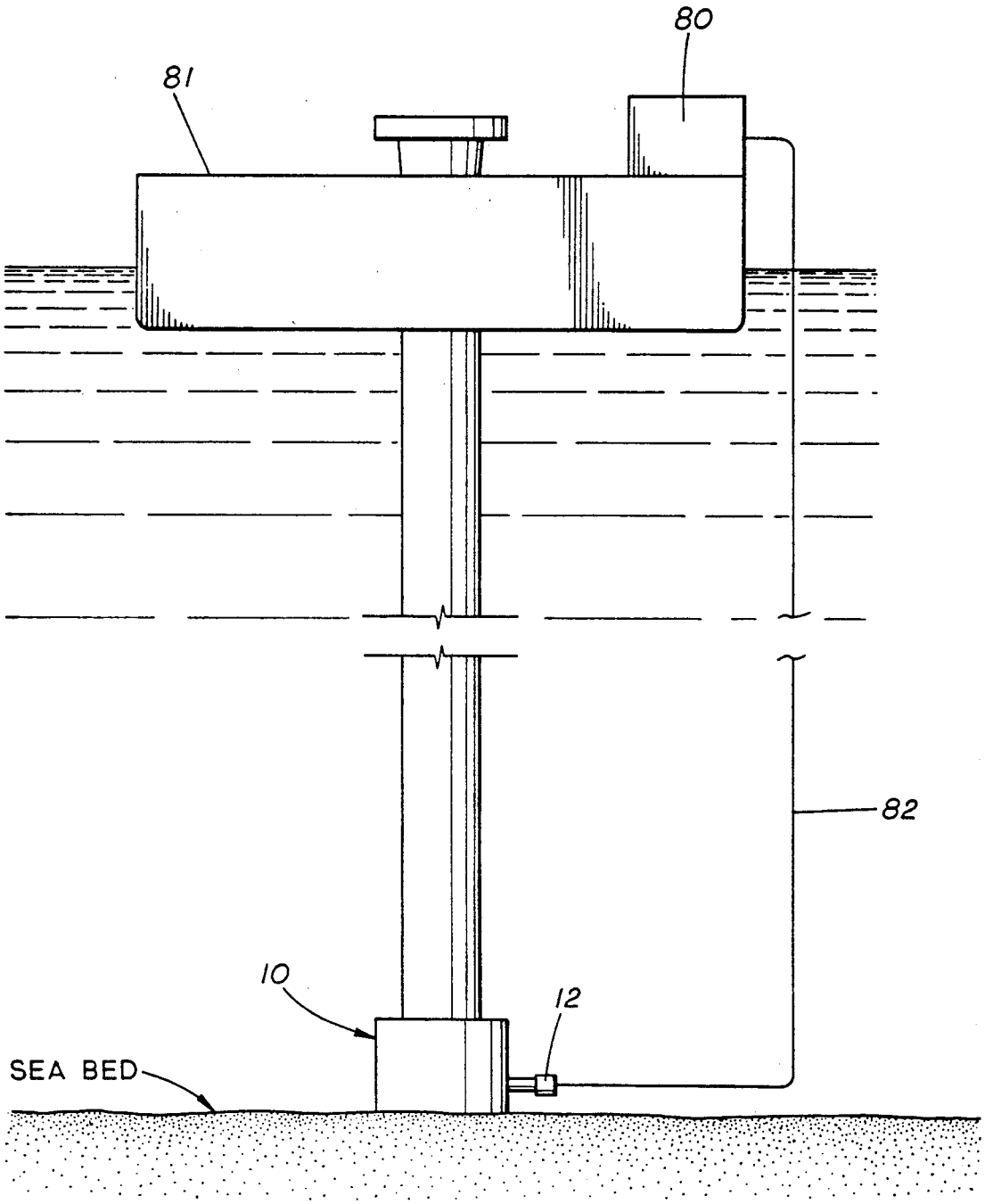
FIG. 5 schematically illustrates a subsea blowout preventer with its vent valve according to the present invention, and being connected by a high pressure hose to the pressure source on the rig platform.

Referring now to FIG. 5, to move the valve piston 14 and shaft 16 into open position, hydraulic fluid is pumped from a hydraulic fluid source 80, located on the rig floor 81, through the conduit 54. The conventional pressurized hydraulic fluid source 80 is connected to the conduit 54 by a pressurized hose 82. When the hydraulic pressure is applied on command from the source 80, the fluid pressure on the operator piston 44 causes piston 44 to move against the retaining force of biasing spring 56. Because the surface area of operator piston 44 on which the hydraulic fluid acts is greater than the surface area of valve piston 14 on which the wellbore gas pressure acts, the force on operator piston 44 can be made large enough to move operator piston 44 (and valve piston 14 and shaft 16) against the retaining forces due to the wellbore gases and the biasing spring 56. In the preferred embodiment, the hydraulic operator assembly operates in a range of hydraulic fluid pressures between approximately 1,500 psi and 3,000 psi. This range of hydraulic fluid pressures can vent through the conduit 23 wellbore gases that are at pressures up to 10,000 psi.

As operator piston 44 moves against spring 56 in housing 40, shaft 16 moves valve piston 14 into open position within the central bore of BOP 10. The wellbore gases in the central bore of BOP 10 then enter into the annular space defined by shaft 16 and the walls of aperture 18. The gases pass through the aperture 18 by passing the rib flanges 24 and are vented to the outside of the BOP 10 via open vent conduit 23. Although the gases may be vented directly into the sea, environmental and practical considerations may dictate that the gases be directed into a conduit (not shown) connected to open vent conduit 23 and brought up to the platform 81 for venting or storage.

After the wellbore pressure in the central bore of the BOP 10 has decreased, the valve piston 14 and shaft 16 may be moved into closed position within aperture 18 by decreasing the hydraulic pressure acting on operator piston 44. As the hydraulic pressure acting on operator piston 44 is decreased, spring 56 moves the operator piston 44 back against piston housing cap 50, thereby causing valve piston 14 and shaft 16 to be seated in closed position in aperture 18. The structure of the hydraulic operator assembly 22 is a "failsafe closed" structure. That is, if hydraulic fluid pressure is lost for any reason, then spring 56 automatically closes valve piston 14 and seals off the central bore of the BOP 10.

Although a specific preferred embodiment of the invention has been described, it is to be understood that modifications may be made in the disclosed preferred embodiment without departing from the true spirit and scope of the invention. For example, while a drilling rig and a drilling BOP are illustrated and described herein, the invention contemplates the use of the vent valve described herein in a production BOP to provide a means for venting production pressure if desired. Also, while the preferred embodiment contemplates the use of hydraulic fluid pressure to operate the vent valve assembly, those skilled in the art will recognize that pneumatic pressure may also be used.

What is claimed is:

1. A pressure release valve within a subsea blowout preventer having a first housing and a central passage extending through said first housing, said passage having upper and lower ends, comprising:

a shaft slidably disposed within an aperture through said first housing;

a valve piston mounted on said shaft for sealing said aperture when said shaft and said valve piston are in a closed position;

an open vent conduit through said first housing communication said aperture with the outside of said first housing; and a hydraulic operator assembly mounted on said first housing for moving said shaft and said valve piston into an open position to permit gases within the central passage to flow through said aperture and through said open vent conduit.

2. A pressure release valve as claimed in claim 1 wherein said hydraulic operator assembly comprises:

a second housing;

an operator piston slidably disposed within said second housing;

said operator piston mounted on an end of a portion of said shaft that extends from said aperture through said first housing;

a piston housing cap for sealing said second housing;

biasing means for tending to retain said operator piston against said piston housing cap;

means for providing hydraulic fluid to move said operator piston and said shaft against said biasing means to cause said shaft to move said valve piston into an open position.

* * * * *

UNITED STATES PATENT AND TRADEMARK OFFICE

CERTIFICATE OF CORRECTION

PATENT NO. : 5,012,854

DATED : May 7, 1991

INVENTOR(S) : John A. Bond

It is certified that error appears in the above-identified patent and that said Letters Patent is hereby corrected as shown below:

In Col. 4, Lines 63-64 (Claim 1, line 10-11), change "communication" to -- communicating --.

Signed and Sealed this

Tenth Day of November, 1992

*Attest:*

DOUGLAS B. COMER

*Attesting Officer*

*Acting Commissioner of Patents and Trademarks*